United States Patent [19]

Briggs et al.

[11] 4,037,517

[45] July 26, 1977

[54] FUZE ACTIVATION DEVICE

[75] Inventors: George S. Briggs, Adelphi; Hugh H. Snider, Jr., Silver Spring, both of Md.

[73] Assignee: The United States of America as represented by the Secretary of the Navy, Washington, D.C.

[21] Appl. No.: 726,385

[22] Filed: Sept. 24, 1976

[51] Int. Cl.[2] ..... F42C 15/12; F42C 15/40

[52] U.S. Cl. ..... 89/1.5 D; 102/8; 102/19.2; 102/70 R; 102/70.2 GA

[58] Field of Search ..... 89/1.5 D, 1.5 R, 1.5 F, 89/27 F; 102/2, 8, 19.2, 70 R, 70.2 GA, 70 C; 244/137 R

[56] References Cited

U.S. PATENT DOCUMENTS

| | | | |
|---|---|---|---|
| 348,868 | 9/1886 | Straube | 89/27 F |
| 2,892,404 | 6/1959 | Glennon et al. | 102/19.2 X |
| 3,279,318 | 10/1966 | Vass et al. | 89/1.5 F |
| 3,320,890 | 5/1967 | Ciccone et al. | 102/70.2 GA |
| 3,349,709 | 10/1967 | Vilbajo | 102/70.2 GA |
| 3,397,635 | 8/1968 | Madlener et al. | 102/8 |
| 3,476,012 | 11/1969 | Jackson | 89/1.5 D |
| 3,936,019 | 2/1976 | Craigie | 89/1.5 FX |
| 3,961,577 | 6/1976 | O'Steen | 102/70.2 G |

*Primary Examiner*—David H. Brown

*Attorney, Agent, or Firm*—R. S. Sciascia; A. L. Branning

[57] ABSTRACT

An activation device to initiate functioning of a bomb fuze upon ejection of the bomb from an aircraft comprises a tube filled with a fluid or semi-fluid and attached to the skin of the bomb, between the support lugs and beneath the ejection mechanism. One end of the tube is closed and the other end is fitted with a movable piston, with a sensor positioned adjacent to the piston. Upon bomb release, the tube is impacted by the ejection mechanism, displacing the fluid and moving the piston against the sensor. The signal from the sensor initiates fuze action. Piston movement may be utilized in any suitable manner, such as initiating an explosive device, impacting upon a piezoelectric element, or unlocking a mechanical linkage.

32 Claims, 9 Drawing Figures

FUZE ACTIVATION DEVICE

BACKGROUND OF THE INVENTION

The present invention relates generally to fuzes, and more particularly to an activation device which will initiate functioning of a bomb fuze upon bomb ejection from an aircraft.

Historically, fuzes on bombs deployed from an aircraft have been initiated, or activated, by mechanical or electrical means. Mechanical activating devices generally employ an arming wire or some type of hardware to interconnect the bomb fuze to the bomb rack, with the arming wire mechanically locking the fuze to prevent its arming before the bomb is released from the aircraft. Electrical fuze activating devices employ an electrical connection between the bomb and the rack to control fuze activation, usually via a female socket on the bomb meshing with a male socket on the rack. Use of electrically-operated fuze activating devices provides greater flexibility in choosing the proper mode of fuze activation from the function control selector located in the cockpit.

Whichever means is used, though, some form of fuze activatng control attachment between the bomb and the aircraft is essential. Existing systems possess a number of shortcomings. For example, time and manpower are required, in addition to the loading of the bombs, to effect and to disconnect, if necessary, the fuze-activation connections. Because of the complexity of the fuzes and the wide variations in the design of fuzes and aircraft bomb support racks, extensive training programs and operational manuals are required.

Substantial degradation of reliability and/or safety exist in many of the present fuze activation systems because of their complexity and because of the numerous manual procedures involved in the loading and unlocking of bombs and the connecting and disconnecting of the fuze activation mechanisms. Furthermore, particularly with the mechanical fuze activating mechanisms, some of the present concepts limit aircraft delivery tactics because of the limited fuze activating modes. In considering delivery tactics and impact accuracy, the activation of the fuze at bomb ejection offers a more precise time zero, i.e., the time basis from which fuze function is measured, which can improve safe bomb-aircraft separation and permit better fuze functioning, particularly in retard bomb delivery.

SUMMARY OF THE INVENTION

Accordingly, one object of the present invention is to provide a fuze activating device particularly adapted for use on an aircraft bomb ejection rack.

Another object of the invention is to provide a fuze activating device having improved reliability and safety.

Another object of the invention is to provide an improved fuze activating device that does not require direct interconnections between the aircraft and the fuze.

Yet another object of the invention is to provide an improved fuze activating device which does not require special handling procedures during weapon stowage and loading onto the aircraft.

A futher object of the invention is to provide an improved fuze activation device which requires no action by weapons loading personnel to prepare the fuze for use.

Still a further object of the invention is to provide a sensor and an energy source which detects bomb ejection and provides the energy to initiate bomb fuze activation.

These and other objects of the invention are achieved by providing a device to initiate bomb fuze functioning which is secured to the skin of the weapon, between the attachment/support lugs. The fuze activation device comprises a small tube, sealed at one end, filled with a fluid, and closedat the other end with a movable piston. A sensor, impacted by the piston, is positioned adjacent thereto.

At weapon release, the bomb ejection foot strikes the tube with sufficient force to flatten it, displacing the fluid and forcing the piston into contact with the sensor. The signal from the sensor is transmitted to the fuze to initiate functioning thereof. Several methods are described to utilize the piston movement to initiate fuze action.

BRIEF DESCRIPTION OF THE DRAWINGS

A more complete understanding of the invention and a fuller appreciation of the many attendant advantages thereof will be readily derived by reference to the following detailed description when considered in connection with the accompanying drawings, wherein.

DESCRIPTION OF THE PREFERRED EMBODIMENT

Figure 1:
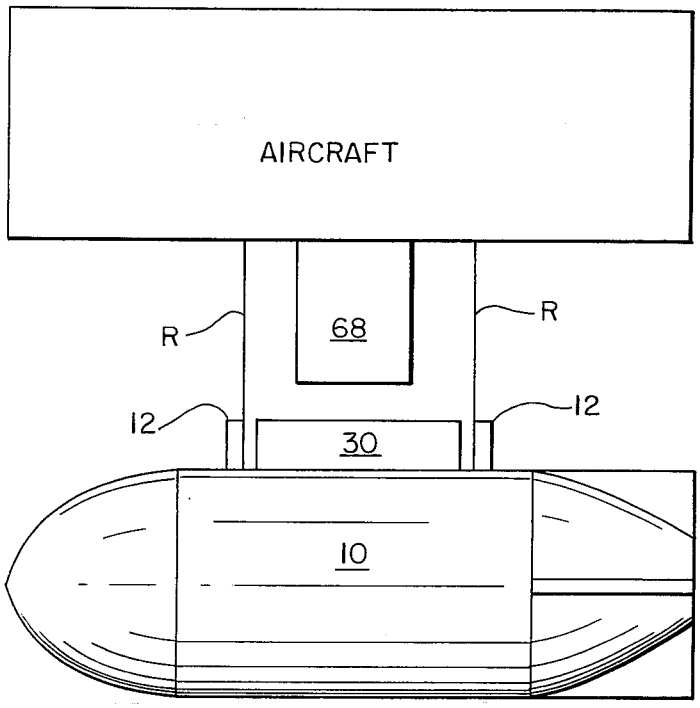
FIG. 1 depicts an overall view of the system

Referring now to the drawings wherein like reference characters designate identical or corresponding parts throughout the several views, and more particularly to FIG.1 thereof, a bomb 10, to be delivered from an aircraft, is shown with an embodiment of the present invention 30 installed thereon, extending principally between attachment lugs 12. The bomb ejector mechanism on most aircrat bomb racks generally as R is usually located between the lugs 12. Also visible is one example of a possible fuze power source 14, which extends into the air flow after the bomb 10 has been released from the aircraft. For clarity of viewing, the aircraft structure associted with bomb support and deployment have been shown only schematically in the drawings. This equipment is known to those familiar with the art and need not be further considered hereinafter.

Figure 2:
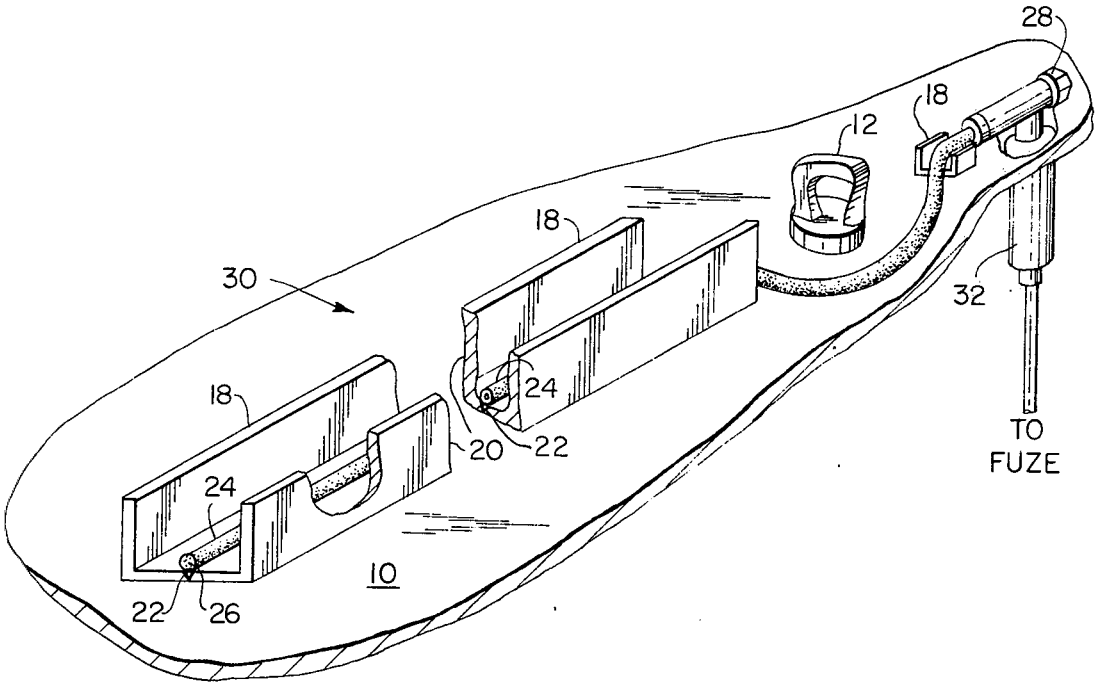
FIG. 2 shows one configuration of the present fuze activation device.

Shown in FIG. 2, in larger scale than FIG. 1, is a fragmentary section of the bomb 10 with the fuze activation device 30 positioned thereon. Attached to the surface of the bomb 10 is a safety channel 18 of U-shape cross section which may be extruded, or otherwise fabricated, from suitable material and positioned on the skin of the bomb to receive the fuze activation device 30. The primary purpose of the protective channel is to ensure the structural integrity of the crush tube 24, described more fully hereinbelow. It shields the tube and device 30 from inadvertent forces during handling, stowage, and loading of the bomb. The distance between the upstanding sides 20 of the channel is sufficient for the bomb ejection mechanism to clear the channel and impact upon the tube 24 of the device 30. An optional longitudinal depression 22 may be provided along the length of the channel to help position the activation device.

While the safety channel 18 shown in FIGS. 1 and 2 is of U-shape cross section, any other appropriate shape would be equally suitable, and instead of being an additional item of hardware attached to the bomb, the safety channel may be formed directly into the skin thereof to receive the fuze action device. The add-on protective channel is most appropriate for providing existing bombs with the presently-disclosed invention, while a safety channel integrally formed in the skin of the bomb would be more appropriate for those bombs initially designed to be compatible with the present invention.

Other means of protecting the device 30 against accidental activation are also comprehended. For example, a removable shield, similar in construction to the protective channel 18, may be placed over the activation device and removed just prior to loading onto the aircraft bomb rock. While this maybe a simple and economical expedient to provide the added protection, an additional step would then be required of personnel loading the bomb. However, in view of the overall simplification of the loading process effected by the present invention, the simple step of removing a protective cover would notbe onerous. The entire bomb may be encased in a synthetic, heat-shrinkable material in which the protective channel can be directly molded. This type of covering would additionally provide thermal protection to the explosive material within the bomb, and would shroud any wires or cables attached to the bomb skin.

It should be noted, though, that a protective channel is not absolutely necessary. Since accidental crushing of the activation tube does not render the bomb unsafe, but merely ineffective, and since redundant safety means within existing safety and arming device prevent placing the bomb in the armed mode by such an accidental crushing, a certain amount of crushing may be acceptable if the reliability of the overall weapons load of the aircraft is not adversely affected by a very limited number of ineffective bombs.

The fuze activation device 30 (FIG. 2) comprises an elongated tube 24 of suitable material, such as stainless steel or copper, which is sealed at one end 26 and closed at the other end by a fitting 28, with the intervening enclosed volume of the tube filled with a working substance 34, such as a fluid or semi-fluid. The tube 24 is appropriately secured to the base of the protective channel 18, and the fitting 28 joins the tube to a reservoir 32, which extends into the bomb adjacent to the fuze (not shown).

Referring now to FIGS. 3, the activation device 30 can be seen in greater detail. End 26 of tube 24 is closed by a plug 35, which can be removed to permit filling of the tube with the working substance 34.

Fitting 28, similar to a standard T fluid coupling, joins the tube 24 to a reservoir 32. End cap 36 closes the other branch of the fitting 28, and may also be removed for filling of the tube 24. The reservoir 32 includes a tubular housing 38 attached to the fitting 28 and has extending therethrough an elongated cylinder 40 which is closed at the lower end with a reciprocating piston member 42. The volume within the housing 38 surrounding the cylinder 40 defines an expansion chamber 44 to accomodate thermal expansion of the working substance 34. A fluid seal 45 prevents leaks from the chamber 44 along the cylinder 40.

Working substance 34 fills the tube 24, the fitting 28 and the cylinder 40 above the piston member 42. A port 46 in the sidewall of the cylinder 40 provides fluid communication between the inner volume of the cylinder and the expansion chamber 44. The diameter of the port 46 is of such a size as to permit fluid flow therethrough under thermal expansion and contraction of the fluid, but does not permit flow under the impulse condition experienced during crushing of the tube 24 by the bomb ejection mechanism. Piston 42, sealed against the inner surface of the cylinder by an O ring 48, is immobilized by a shear element 50 extending through aligned apertures in the cylinder 40 and the piston. The lower end of the piston terminates in a cone 52 having a specially-designed tip 53. The piston may be fabricated of steel, plastic body with a steel cone, or any other suitable material.

Depending on other design criteria, the piston may be free-floating; i.e., there is no shear i.e., there is no shear element immobilizing it. The function of the shear wire is to maintain the position of the piston until it is subjected to a predetermined pressure. In those applications in which a protective channel or shield is not used with the fuze activation device, and a limited amount of deformation of the tube 24 is acceptable, then the piston will be free-floating. With the free-floating piston, the piston may contact the stop washer 56 or the piezoelectric element 64 (described hereinbelow) when the activation device 30 is exposed to elevated temperatures of 165° F or higher. However, since weapon release usually occurs at lower temperatures, i.e., at higher altitudes, a reduction in the volume of the working substance 34 will occur, causing the piston to be retracted to such a position that upon crushing of the tube 24 during bomb ejection the piston will be accelerated to a sufficient velocity to impact and initiate the stab primer 58 or piezoelectric element 64.

Attached to the lower end (as seen in FIGS. 3) of the cylinder 40 is a support element 54, bored to receive a stop washer 56 and a stab primer 58 of explosive material. A pyrotechnic detonator 60, such as mild detonating fuze (MDF) extends through an axial passage in the support element 54 and couples to an initiator means in the bomb fuze (not shown). The stop washer 56, interposed between the piston member 42 and the stab primer 58, is provided with a central aperture 62 which cooperates with the cone 52 of the piston member to arrest the motion thereof. The shape and dimensions of the tip 53 of the piston, and the diameter of the aperture 62 are appropriately selected to permit penetration of the tip into the stab primer with sufficient velocity to generate sufficient heat to initiate the primer. These design considerations are well known to one skilled in the art, and do not require further elabroation herein. Very slow or relatively slow rates of tube crushing would not activate the signal generator, even with a free-floating piston design, since the necessary impact velocity is not achieved.

An alternative means of utilizing the motion of the piston member to produce an output signal indicative of weapon ejection is shown in FIG. **3*b* wherein a piezoelectric element 64 is positioned within the support element, adjacent to the stab primer 58. A conductor 66** transmits the output signal of the piezoelectric element to the fuze initiator means, such as an electrically-fired squib. Impact of the piston member upon the stab primer results in crushing of the piezoelectric element by the ensuing high-pressure gases, and the electric current produced is transmitted via the conductor 66 to the electric squib. The firing of the squib is utilized to place the bomb fuze in its operative mode.

Figures 3A, 3B:
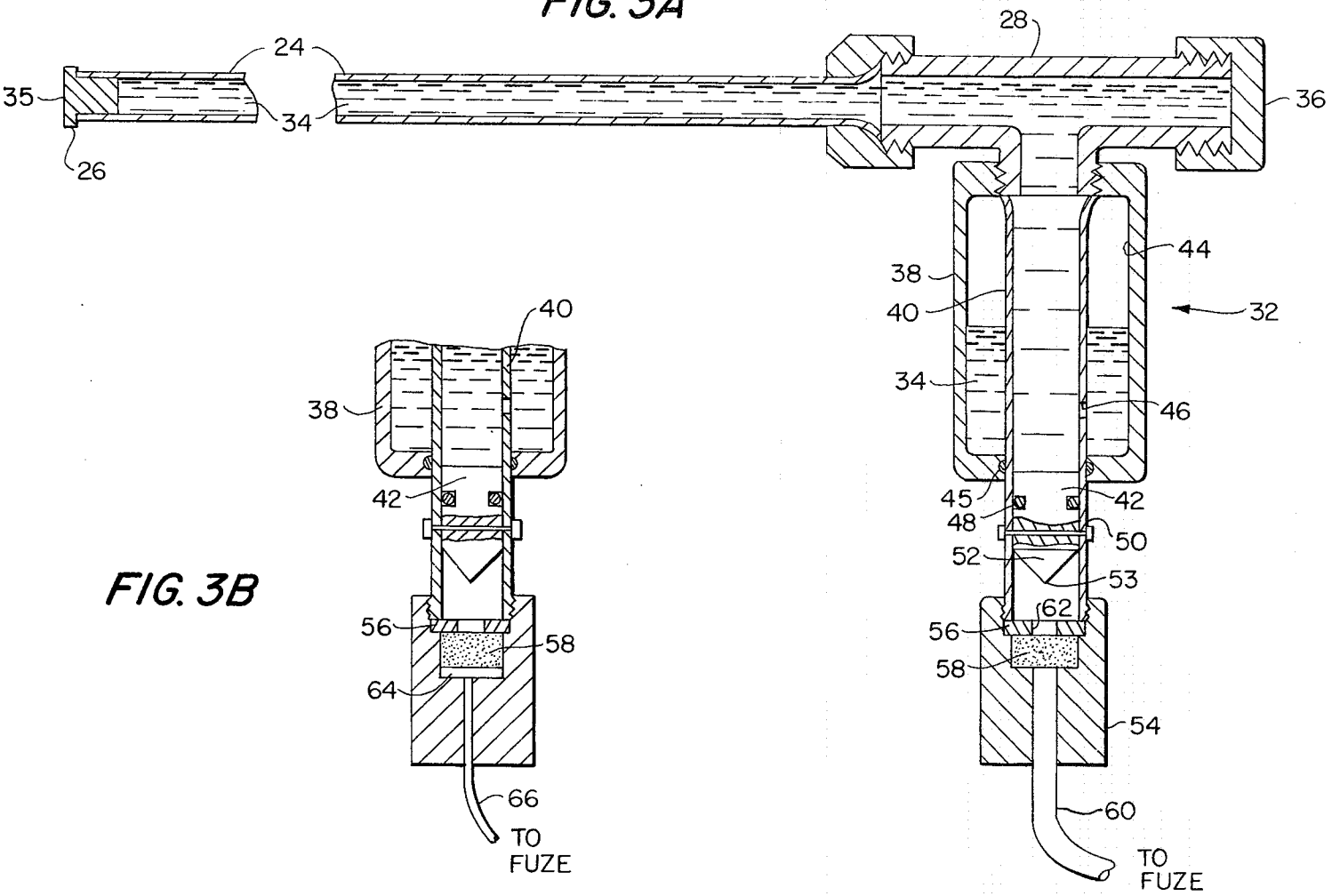
Figure 4A:
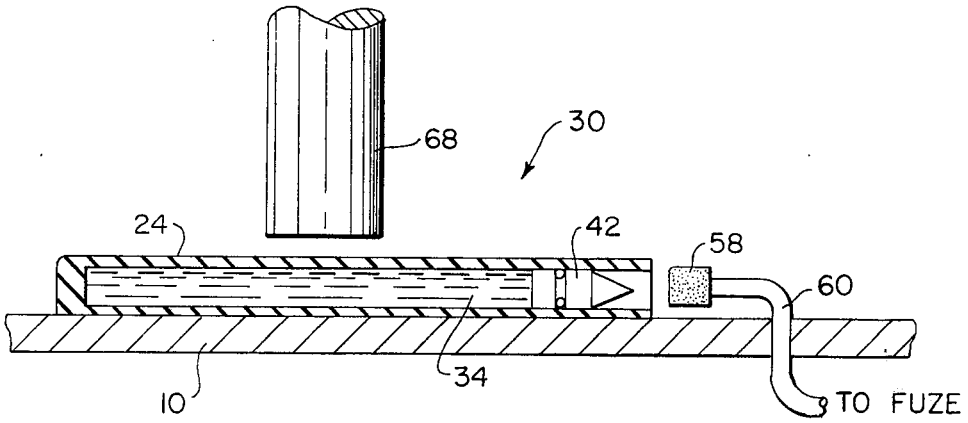
FIGS. 4*a* and 4*b* are schematics of the operation of the invention, illustrating the condition of the device prior to and after activation of the bomb ejection mechanism, respectively.
Figure 4B:
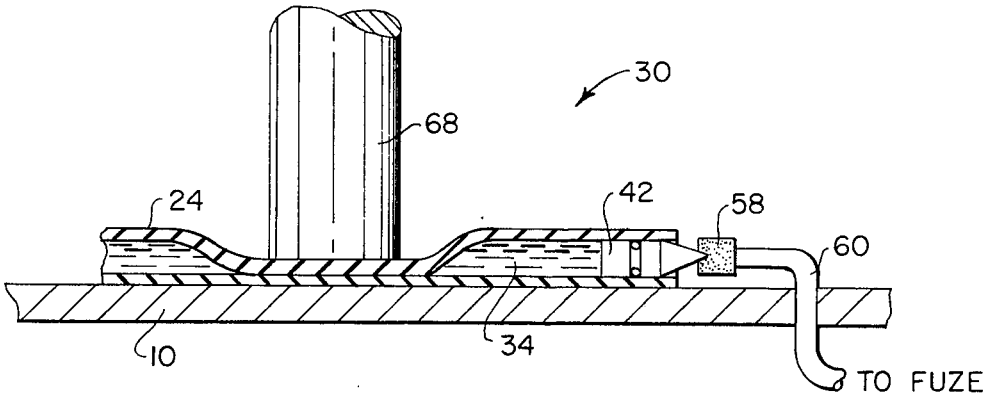

The operation of the fuze activation device 30 may be seen by referring to the schematics of FIGS. 4*a* and 4*b*. The bomb 10 is secured to the aircraft bomb rack by the attachment lugs 12 in the usual manner, with the tube 24 of the activation device positioned below the bomb ejector mechanism 68. Release of the bomb activates the ejector mechanism, normally explosively driven, and simultaneously releases the holding latches engaging the attacment lugs. Impact of the ejector mechanism with the tube 24 crushes it, causing the working substance to drive the piston member 42 against the stab primer 58, which in turn initiates the mild detonating fuze 60. The fuze in turn initiates an explosive charge in the bomb fuze to place the fuze in its operative mode. When a piezoelectric element is used (FIG. 3*b*), detonation of the stab primer crushes the element, and the resulting current is used to fire an electric squib in the fuze. Again, an explosive charge is initiated to activate the bomb fuze.

An example of a fuze which may be used with the present activation device is described in the U.S. Pat. No. 3,961,577, issued June 8, 1976 to J. K. O'Steen. With the air-driven, velocity-discriminating safing and arming device described therein, the explosive charge initiated with the output of the present invention would extend the air flow-sensing snorkel as the bomb is released. The safing-and-arming mechanism and the fuze would then function in their usual fashion, as described in the aforesaid patent. Of course, other types of safing-and-arming mechanisms and other types of fuzes would be compatible with the presently-disclosed activaton device.

Any material capable of transmitting the impact force of the ejector mechanism into a piston-displacing force, and which is not adversely affected operatively by the temperature extremes which a bomb may experience, may be used as the working substance.

Examples of materials suitable as the working substance would include liquids, such as oil or silicone-based synthetic oil; semi-liquids, such as grease or gel; and non-liquids, such as microbeads or microspheres of glass or plastic. Silicone-based oils possess the advantages of inertness, lower sensitivity to temperature variations, and longer storage life. Non-liquids eliminate potential leakage problems. A combination of silicone oil and microspheres has proven to be a good working substance, with a high degree of thermal stablity. Microspheres with diameters in the range of 0.004 inch —0.01 inch are sufficiently small to permit flow similar to that of a fluid and are substantially inert to temperature variations.

Figure 3C:
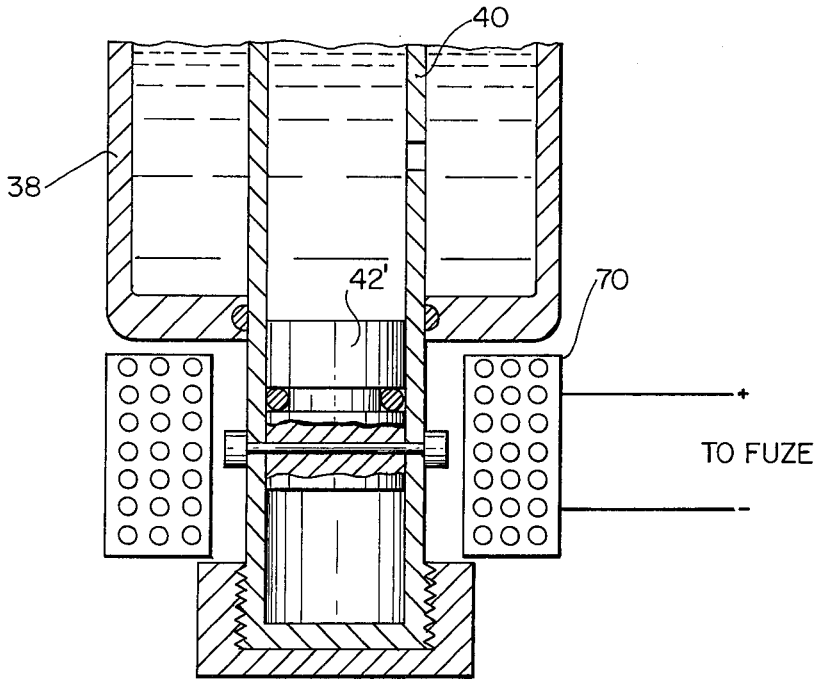
FIGS. 3*a*, 3*b*, and 3*c* illustrate details of three embodiments of the invention.
Figure 1A:
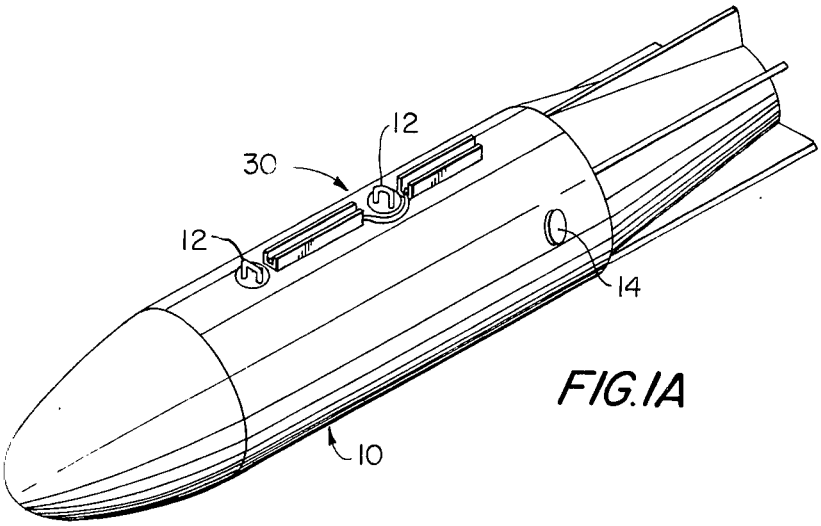
FIG. 1*a* illustrates one embodiment of the invention installed on a bomb.

In addition to the pyrotechnic and piezoelectric mechanisms described hereinabove for transmitting the fuze-initiating signal from the activation device, alternative means are within the scope of the present invention. For example, in the piezoelectric mechanism of FIG. 3*b*, the piston can impact directly upon the piezoelectric crystal to generate the electric current, without the need for the intervening explosive charge. Other alternative devices which could sense and utilize movement of the piston include an arrangement which is shown in FIG. 3*c* wherein a piston 42' fabricated of a magnetic material moves through a coil of wire 70 to produce an electric current that provides fuze activation energy.

Figure 4C:
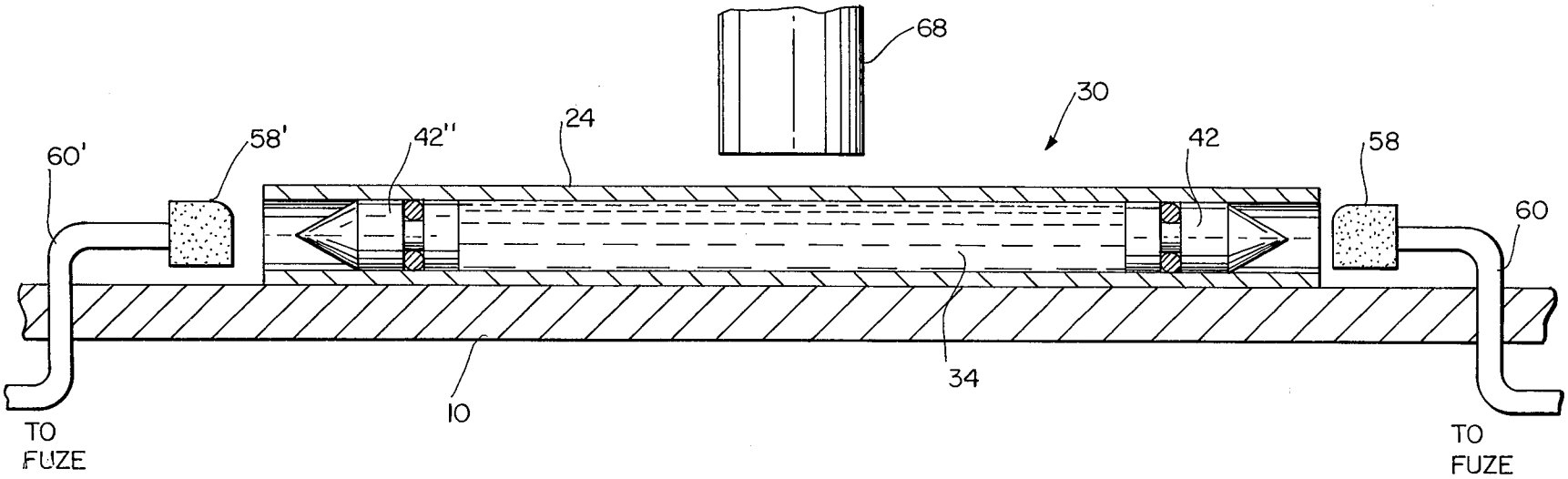
FIG. 4*c* shows a further embodiment.

Another alternate design which would further enhance the reliability of the system provides movable pistons at both ends of the crush tube to permit fuze activation from either end of a bomb. FIG. 4*c* shows this embodiment in which another piston 42" is used to seal the other end of tube 24. A second pyrotechnic detonator 60' and stab primer 58' are also provided.

The improved fuze activation device described hereinabove provides a simple, effective and reliable means to initiate bomb fuze functioning upon ejection of the bomb from the delivery aircraft. The device provides, in the same unit, an event sensor which immediately and reliability detects bomb ejection and a self-contained source of energy to initiate fuze activation.

A primary advantage of the present invention is the elimination of any affirmative action by personnel loading the bombs, i.e., effecting control connections between the bomb fuze and the aircraft, to prepare the fuze for use. Reliability of fuze initiation is greatly enhanced by the removal of this possibility for human error which traditionally has characterized existing activation devices.

In the example installation described hereinabove, the fuze activation device was positioned between the bomb support lugs and beneath the ejector mechanism. Of course if the ejector mechanism is located elsewhere relative to the bomb, the presently disclosed activation would be equally effective, as long as it is in a position to be impacted by the ejector mechanism.

While the described fuze activation device is extended principally for use with aircrafts having bomb ejector mechanisms, and in this respects seems to be a limitation on the system, it should be quickly noted that an increasing number of military aircraft are being provided with this type of bomb deployment system and some existing aircrafts are being retrofitted with bomb ejectors.

Obviously numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. A sensor and energy source for detecting and registering bomb ejection and for generating an energy signal which comprises:

a crushable container having a substantially incompressible working substance;

a movable impact element positioned adjacent one end of said container, said element movable in response to displacement of said working substance; and means positioned adjacent to and responsive to said impact element for generating an energy output signal, whereupon bomb ejection, said container is crushed to displace the working substance, forcing said impact element against said energy generating means to produce an output control signal associated with bomb ejection.

2. The sensor and energy source of claim 1 wherein there is a movable impact element positioned adjacent each end of said container, each element being movable in response to displacement of said working substance; and means positioned adjacent to and responsive to each of said impact elements for generating an energy output signal.

3. The sensor and energy source of claim 1 further including signal transmission means for coupling said energy generating means to a bomb fuze to control activation of the fuze.

4. The sensor and energy source of claim 2 wherein said container is an elongated cylindrical tube having one end sealed and said impact element is a displaceable piston member forming a fluid seal adjacent the other end of said tube.

5. The sensor and energy source of claim 1 wherein said energy generating means includes a piezoelectric element responsive to the impact of said piston member to produce an output current.

6. The sensor and energy source of claim 4 further comprising a shear element for immobilizing said piston member prior to the application of a predetermined pressure on said piston member by said working substance.

7. The sensor and energy source of claim 4 wherein said piston member is provided with a tapered end portion positioned adjacent said energy generating means.

8. The sensor and energy source of claim 7 wherein said energy generating means includes a pyrotechnic component responsive to the impact of said piston member tapered portion to produce an output signal.

9. The sensor and energy source of claim 8 further including an apertured element positioned between said piston member and said pyrotechnic component to control the impact of said piston member tapered portion with said pyrotechnic component.

10. A control device to initiate bomb fuze functioning in response to bomb ejection comprising:

a container positioned in cooperative relationship adjacent to a bomb ejection mechanism;

a substantially incompressible working substance within said container;

an impact element positioned adjacent one end of said container and in contact with said working substance, said element movable in response to displacement of said working substance;

energy generating means positioned adjacent to and responsive to said impact element to produce an output energy signal; and signal transmission means coupling said energy means to a bomb fuze, whereupon bomb ejection, said container is crushed, displacing the working substance and forcing said impact element against said energy generating means to produce an output energy signal to control activation of the bomb fuze.

11. The control device of claim 10 wherein there is a movable impact element positioned adjacent each end of said container and in contact with said working substance, each element being movable in response to displacement of said working substance;

energy generating means positioned adjacent to and responsive to each of said impact elements to produce an output energy signal; and signal transmission means coupling each of said energy means to a bomb fuze.

12. The control device of claim 10 wherein said container is an elongated cylindrical tube having one end sealed and said impact element is a displaceable piston member forming a fluid seal adjacent the other end of said tube.

13. The control device of claim 12 further comprising a protective member to maintain the structural integrity of said tube prior to bomb ejection.

14. The control device of claim 13 wherein said energy generating means includes a piezoelectric element responsive to the impact of said piston member to produce an output current and said signal transmission means include a current conductor.

15. The control device of claim 13 further comprising a shear element for immobilizing said piston member prior to the exertion of a predetermined pressure on said piston member by said working substance.

16. The control device of claim 13 wherein said piston member is provided with a tapered end portion positioned adjacent said energy generating means and said energy generating means includes a pyrotechnic component responsive to the impact of said piston member tapered portion to produce an output signal.

17. The control device of claim 16 wherein said signal transmission means includes a cord of pyrotechnic material.

18. The control device of claim 17 further including an apertured element positioned between said piston member and said pyrotechnic component to control the impact of said piston member tapered portion with said pyrotechnic component.

19. In combination with an aircraft having a bomb support structure, a controlled, extensible bomb ejection mechanism, and a bomb attachable to the support structure and having a fuze, a device to initiate the functioning of the bomb fuze, the improvements comprising:

a crushable tube positioned in cooperative relationship adjacent to the bomb ejection mechanism;

a substatially incompressible working substance within said tube;

an impact element positioned adjacent one end of said tube and in contact with said working substance, said element movable in response to displacement of said working substance;

energy generating means positioned adjacent to and responsive to said impact element to produce an output energy signal; and signal transmission means coupling said generating means to the bomb fuze, whereupon activation and extension of the bomb ejection mechanism, said tube is crushed, displacing the working substance and forcing said impact element against said energy means to produce an output energy signal which initiates functioning of the bomb fuze.

20. The combinaton of claim 19 wherein there is an impact element positioned adjacent each end of said tube and in contact with said working substance, each element being movable in response to displacement of said working substance;

energy generating means positioned adjacent to and responsive to each of said impact elements to produce an output energy signal; and signal transmission means coupling each of said generating means to the bomb fuze.

21. The combination of claim 19 wherein said crushable tube is an elongated cylindrical tube having one end sealed and said impact element is a displaceable piston member forming a fluid seal adjacent to the other end of said tube.

22. The combination of claim 21 further comprising a protective member to maintain the structural integrity of said tube prior to activation and extension of the bomb ejection mechanism.

23. The combination of claim 22 wherein said energy generating means includes a piezoelectric element responsive to the impact of said piston member to produce an output current and said signal transmission means includes a current conductor.

24. The combination of claim 22 further comprising a shear element for immobilizing said piston member prior to the exertion of a predetermined pressure on said piston member by said working substance.

25. The combination of claim 22 wherein said substance is a thermally stable fluid.

26. The combination of claim 22 wherein said working substance is a mixture of a fluid and a plurality of microspheres.

27. The combination of claim 22 further comprising:

a tapered end portion on said piston member adjacent said energy generating means; and an apertured element positioned between said piston member and said energy generating means to control the impact of said piston member tapered portion with said energy generating means.

28. The combination of claim 27 wherein said energy generating means includes a pyrotechnic component responsive to the impact of said piston member tapered portion to produce an output signal and said signal transmission means includes a cord of pyrotechnic material.

29. The combination of claim 22 wherein said crushable tube is positioned below the bomb ejection mechanism and is impacted by said mechanism in the operative condition of the fuze initiation device.

30. The combination claim 29 wherein said protective member is a channeled structure having spaced, upstanding side elements extending parallel to said crush tube to shield the tube.

31. In combination with an aircraft having a bomb support structure, a controlled, extensible bomb ejection mechanism, and a bomb attachable to the support structure and having a fuze, a device to initiate the functioning of the bomb fuze, the improvements comprising:

a crushable tube positioned in cooperative relationship adjacent to the bomb ejection mechanism;

a substantially incompressible working substance within said tube;

an element positioned adjacent one end of said tube and in contact with said working substance, said element movable in response to displacement of said working substance;

energy generating means positioned adjacent to and responsive to said element to produce an output energy signal; and signal transmission means coupling said generating means to the bomb fuze;

said crushable tube is an elongated cylindrical tube having one end sealed and said element is a displaceable piston member, fabricated of a magnetic material, forming a fluid seal adjacent to the other end of said tube;

whereupon activation and extension of the bomb ejection mechanism, said tube is crushed, displacing the working substance and forcing said element through said energy means to produce an output energy signal which initiates functioning of the bomb fuze.

32. The combination of claim 31 wherein said energy generating means includes a coil of wire responsive to the motion of said piston member to produce an output current and said signal transmission means includes a current conductor.

* * * * *